US008215937B2

(12) United States Patent
Inagaki et al.

(10) Patent No.: US 8,215,937 B2
(45) Date of Patent: Jul. 10, 2012

(54) FLUID MACHINE WITH DIVIDED HOUSING

(75) Inventors: Masahiro Inagaki, Kariya (JP); Shinya Yamamoto, Kariya (JP); Makoto Yoshikawa, Kariya (JP); Yuya Izawa, Kariya (JP)

(73) Assignee: Kabushiki Kaisha Toyota Jidoshokki (JP)

( * ) Notice: Subject to any disclaimer, the term of this patent is extended or adjusted under 35 U.S.C. 154(b) by 798 days.

(21) Appl. No.: 12/373,924

(22) PCT Filed: Jul. 19, 2007

(86) PCT No.: PCT/JP2007/064221

§ 371 (c)(1),
(2), (4) Date: Jan. 15, 2009

(87) PCT Pub. No.: WO2008/010539

PCT Pub. Date: Jan. 24, 2008

(65) Prior Publication Data

US 2010/0047104 A1 Feb. 25, 2010

(30) Foreign Application Priority Data

Jul. 19, 2006 (JP) ..... 2006-196743

(51) Int. Cl.
*F01C 1/18* (2006.01)
*F04C 2/00* (2006.01)
*F04C 2/18* (2006.01)

(52) U.S. Cl. ..... 418/206.7; 384/490; 384/537

(58) Field of Classification Search ..... 418/206.7; 384/452–455, 499, 504, 512, 490, 537
See application file for complete search history.

(56) References Cited

U.S. PATENT DOCUMENTS

| | | | | |
|---|---|---|---|---|
| 5,173,041 | A | 12/1992 | Niimura et al. | |
| 5,655,844 | A * | 8/1997 | Takano | 384/453 |
| 6,506,038 | B2 * | 1/2003 | Sjoholm et al. | 418/201.1 |
| 6,572,351 | B2 | 6/2003 | Durand et al. | |
| 2002/0141893 | A1 | 10/2002 | Hoshino et al. | |
| 2003/0206672 | A1 * | 11/2003 | Obara | 384/480 |
| 2006/0034670 | A1 | 2/2006 | Sugita et al. | |
| 2008/0118319 | A1 | 5/2008 | Sugita et al. | |
| 2008/0118321 | A1 | 5/2008 | Sugita et al. | |

FOREIGN PATENT DOCUMENTS

| | | | |
|---|---|---|---|
| JP | 3145594 | A | 6/1991 |
| JP | 4132895 | A | 5/1992 |
| JP | 2002257244 | A | 9/2002 |
| JP | 2002349490 | A | 12/2002 |
| JP | 2004507641 | A | 3/2004 |
| KR | 20050114251 | A | 5/2005 |

* cited by examiner

*Primary Examiner* — Mary A Davis
(74) *Attorney, Agent, or Firm* — Woodcock Washburn LLP

(57) ABSTRACT

A housing (2) of a Roots pump (1) supports a drive shaft (3) and a driven shaft (4) with radial bearings (32, 33) so as to be rotatable. The housing (2) is formed by joining an upper housing member (20) to a lower housing member (10). The lower housing member (10) has lower bearing support portions (13), and the upper housing member (20) has upper bearing support portions (23). Opening edges (13*a*) of each lower bearing support portion (13) are positioned above the centers (P1) of the bearings (32, 33). An opening width (T1) of each lower bearing support portion (13) is smaller than the diameter (D1) of the bearings (32, 33). This structure suppresses the bearings (32, 33) from being separated from the lower housing member (10) during an assembling operation of the fluid machine.

5 Claims, 6 Drawing Sheets

FLUID MACHINE WITH DIVIDED HOUSING

FIELD OF THE INVENTION

The present invention relates to a fluid machine that rotates a rotor according to rotation of a rotary shaft to transport fluid.

BACKGROUND OF THE INVENTION

Recently, there has been a demand for easy-to-assemble fluid machines, and fluid machines in which a rotary shaft is efficiently assembled with a casing have been proposed (see Patent Documents 1 and 2).

The fluid machine disclosed in Patent Document 1 has a casing that is divided into two parts, or an upper casing member and a lower casing member. A rotary shaft is inserted through a ring (block body) with a bearing and a shaft sealing device. A protrusion protruding from the ring is fitted to a recess portion of the lower casing. Then, the upper casing member is assembled to the lower casing member to assemble the fluid machine.

The fluid machine disclosed in Patent Document 2 is a multistage vacuum pump. The vacuum pump has a casing including an upper casing member and a lower casing member, and a plurality of pump operation chambers are defined in the casing. A drive shaft and a driven shaft are each supported to the lower casing member with a bearing and a shaft sealing device. The drive shaft has a drive gear and a plurality of drive rotors, and the driven shaft has a driven gear and a plurality of driven rotors. The upper casing member is assembled to the lower casing member to assemble the fluid machine. Before the upper casing member is assembled to the lower casing member, a clearance between each rotor and an inner surface of a pump operation chamber is adjusted. An engagement position of the drive gear and the driven gear that are timing gears is adjusted to adjust the phase difference between the drive rotor and the driven rotor.

When the fluid machine disclosed in Patent Document 1 is assembled, the ring and the bearing are separated from the lower casing member after the rotary shaft is supported to the lower casing member with the ring. Similarly, when the fluid machine disclosed in Patent Document 2 is assembled, the bearing is separated from the lower casing member after the rotary shaft is supported to the lower casing member with the bearing. Further, in the fluid machine disclosed in Patent Document 2, if the bearing is separated from the lower casing member, the phase difference between the drive rotor and the driven rotor cannot be accurately adjusted. Therefore, in some cases, the upper casing member is assembled to the lower casing member with an inaccurate phase difference between the drive rotor and the driven rotor.

Patent Document 1: Japanese Laid-Open Patent Publication No. 2002-349490

Patent Document 2: Japanese Laid-Open Patent Publication No. 4-132895

DISCLOSURE OF THE INVENTION

An objective of the present invention is to provide a fluid machine that suppresses a bearing from being separated from a housing during the assembly operation of the fluid machine.

To achieve the foregoing objective, a fluid machine having a rotary shaft, a housing that supports the rotary shaft with a bearing, and a rotor that is provided on the rotary shaft is provided. The housing has the bearing. The rotor is rotated by rotation of the rotary shaft. The fluid machine transports fluid according to the rotation of the rotor. The housing has a two-piece structure having a lower housing member and an upper housing member that is joined to the lower housing member. The lower housing member has a lower bearing support portion that is open upward. The upper housing member has an upper bearing support portion that makes a pair with the lower bearing support portion. The upper bearing support portion is open downward. The lower bearing support portion and the upper bearing support portion support the bearing. An uppermost portion of the lower bearing support portion is positioned above a center of the bearing. An opening width of the lower bearing support portion is smaller than the diameter of the bearing.

According to this configuration, when assembling the fluid machine, a portion of the lower bearing support portion that is above the center of the bearing engages with the bearing in a state where the rotary shaft and the bearing are attached to the lower housing member. This suppresses the bearing from being separated upward from the lower housing member. Therefore, for example, when the bearing is press-fitted to the lower casing member, the bearing is suppressed from being separated from the lower housing member even if an upward force acts on the bearing. In a state where a plurality of rotary shafts are arranged in the lower housing member with bearings, when a timing gear is engaged with each rotary shaft so as to be meshed with each other, the bearing is suppressed from being separated from the lower housing member even if an upward force acts on the bearing.

The lower housing member may have a joint surface that contacts the upper housing member. The entire joint surface is preferably positioned on a same plane. One of the joint surfaces of the lower housing member is a continuous surface that contacts the upper housing member.

According to this configuration, for example, compared to a case in which the lower housing member is processed such that the joint surface has steps, the housing is easily manufactured. Since the whole area of the joint surface is positioned on a single plane, the upper housing member and the lower housing member are flush with each other at a joint portion. This improves the sealing property of the joint portion.

The lower housing member has a lower shaft accommodation portion that accommodates the rotary shaft and a joint surface that contacts the upper housing member. It is preferable that the height of a portion of the joint surface that corresponds to at least the lower shaft accommodation portion is set to be the same as an axis of the rotary shaft.

According to this configuration, for example, when a portion of the joint surface that corresponds to the lower shaft accommodation portion is positioned above the axis of the rotary shaft, the opening width of the lower shaft accommodation portion needs to be greater than the diameter of the rotary shaft such that the rotary shaft is attached to the lower housing member from above smoothly. Therefore, a space exists between the lower shaft accommodation portion and the rotary shaft. However, if the height of the portion of the joint surface that corresponds to the lower shaft accommodation portion is set to be the same as the axis of the rotary shaft, the space between the lower shaft accommodation portion and the rotary shaft becomes smaller. This easily suppresses fluid that is transported by the rotor from passing through the space between a peripheral surface of the rotary shaft and the lower shaft accommodation portion and leaking therefrom.

The lower housing member has a lower shaft accommodation portion that accommodates the rotary shaft. A shaft insertion portion is defined in the lower shaft accommodation portion. The shaft insertion portion preferably has an opening width that is greater than the diameter of a portion of the rotary shaft that is accommodated in the lower shaft accommodation portion.

The rotary shaft can be inserted to the shaft insertion portion from above. Therefore, the rotary shaft can be inserted to the lower shaft accommodation portion from above.

The housing has a seal accommodation portion. The seal accommodation portion accommodates a cylindrical sealing member that seals a space between an inner peripheral surface of the housing and a peripheral surface of the rotary shaft. The seal accommodation portion has a lower seal accommodation portion that is formed in the lower housing member and an upper seal accommodation portion that is formed in the upper housing member. The lower seal accommodation portion opens upward. The upper seal accommodation portion makes a pair with the lower seal accommodation portion. The upper seal accommodation portion opens downward. A shaft insertion portion into which the rotary shaft is inserted is formed in the lower seal accommodation portion. The shaft insertion portion has an opening width that is greater than the diameter of a portion of the rotary shaft that is accommodated in the seal accommodation portion.

The rotary shaft can be inserted to the shaft insertion portion from above. Therefore, the rotary shaft can be inserted to the lower seal accommodation portion from above. The sealing member seals a space between the peripheral surface of the rotary shaft and the inner peripheral surface of the seal accommodation portion. This suppresses the fluid from leaking from the space.

The rotary shaft is one of a drive shaft and a driven shaft that are aligned so as to be parallel to each other in the housing. A drive gear provided on the drive shaft is meshed with a driven gear that is provided on the driven shaft. Rotation of the drive shaft is transmitted from the drive gear to the driven gear such that the driven shaft is rotated synchronously with the drive shaft. Accordingly, a drive rotor that is provided on the drive shaft and a driven rotor that is provided on the driven shaft are engaged to each other so as to be rotatable.

For example, when the drive gear is engaged with the driven gear in a state where the drive rotor is engaged with the driven rotor, the bearing may be separated from the lower housing member. However, the lower bearing support portion suppresses the bearing from being separated. Accordingly, the drive gear is easily engaged with the driven gear.

DETAILED DESCRIPTION OF THE PREFERRED EMBODIMENTS

First Embodiment

Figure 1:
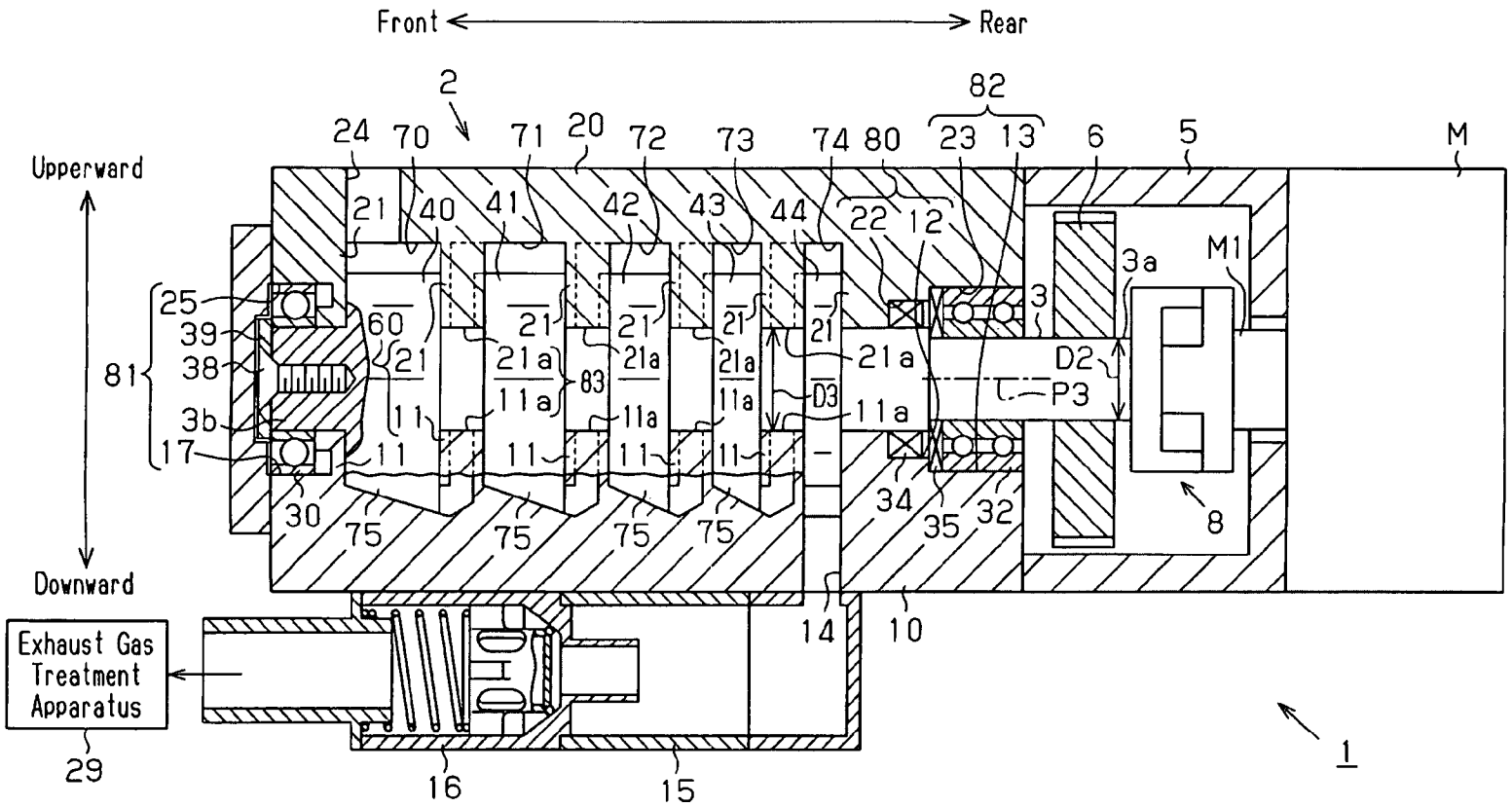
FIG. 1 is a longitudinal cross-sectional view showing a Roots pump according to a first embodiment of the present invention.

A first embodiment which applies a fluid machine of the present invention into a Roots pump will be explained with reference to FIGS. 1 to 5. The upper side in FIG. 1 is referred to as the upper side of a Roots pump 1, and the lower side in FIG. 1 is referred to as the lower side of the Roots pump 1. The left side in FIG. 1 is referred to as the front side of the Roots pump 1, and the right side in FIG. 1 is referred to as the rear side of the Roots pump 1.

Figure 2:
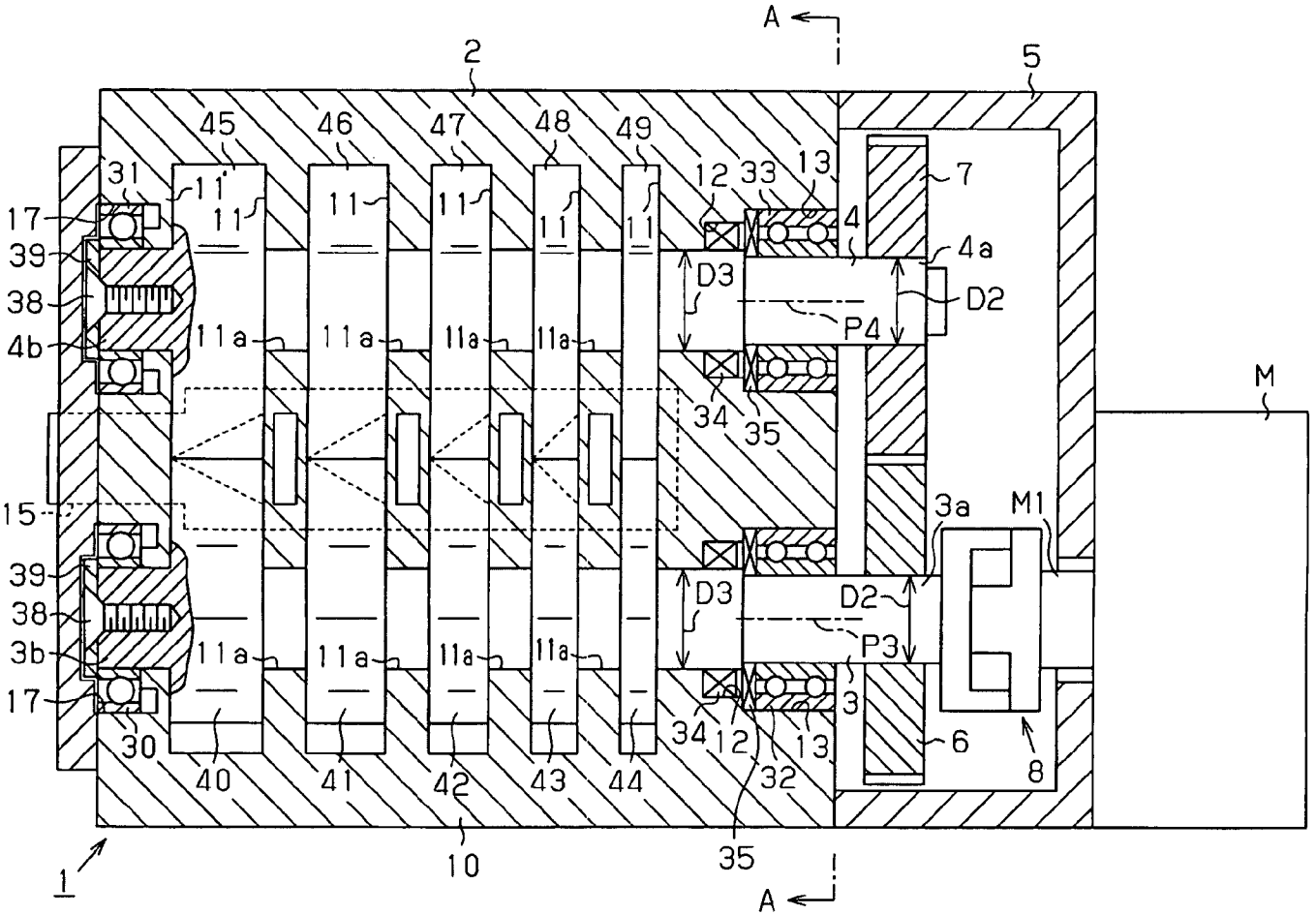
FIG. 2 is a cross-sectional plan view showing the Roots pump of FIG. 1.
Figure 3:
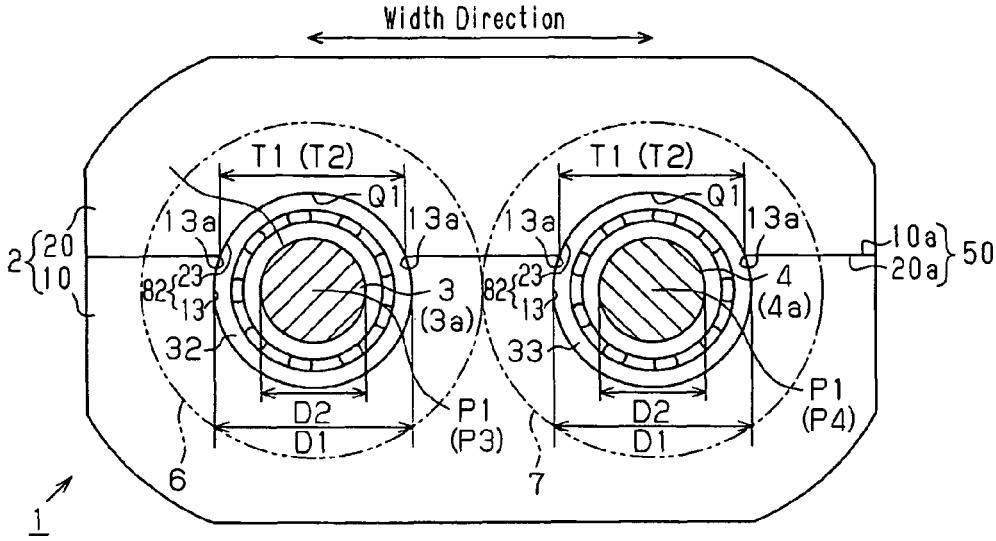
FIG. 3 is a cross-sectional view taken along line A-A in FIG. 2.

As shown in FIGS. 1 and 2, a housing 2 of the Roots pump 1 has a lower housing member 10 and an upper housing member 20 that is joined to the lower housing member 10. The housing 2 has a two-piece structure. As shown in FIG. 3, an upper surface of the lower housing member 10 forms a flat lower joint surface 10*a* that contacts the upper housing member 20. One of the joint surfaces of the lower housing member is a continuous surface that contacts the upper housing member 20. The entire lower joint surface 10*a* is positioned on a same plane. That is, the height of any portions of the lower joint surface 10*a* is on a same plane with respect to the lower surface of the lower housing member 10, that is, a lowermost portion of the lower housing member 10.

Similarly, a lower surface of the upper housing member 20 forms a flat upper joint surface 20*a* that contacts the lower housing member 10. The entire upper joint surface 20*a* is positioned on a same plane. The joint portion of the upper joint surface 20*a* and the lower joint surface 10*a* forms a joint portion 50 of the housing 2.

The two-piece structure is a structure where the upper housing member 20 is joined to the lower housing member 10 in a state where the lower joint surface 10*a* of the lower housing member 10 fully contacts the upper joint surface 20*a* of the upper housing member 20 without having any steps.

As shown in FIG. 2, front bearings 30, 31 are arranged at a front end of the housing 2 so as to be aligned with each other. Rear bearings 32, 33 are arranged at a rear end of the housing 2 so as to be aligned with each other. A drive shaft 3, which is a first rotary shaft, is inserted through the front bearing 30 and the rear bearing 32, each of which is a radial bearing. Similarly, a driven shaft 4, which is a second rotary shaft, is inserted through the front bearing 31 and the rear bearing 33 each of which is a radial bearing. In other words, the front bearing 30 and the rear bearing 32 support the drive shaft 3 rotatably with respect to the housing 2. Similarly, the front bearing 31 and the rear bearing 33 support the driven shaft 4 rotatably with respect to the housing 2. The drive shaft 3 and the driven shaft 4 are arranged in the housing 2 so as to be parallel to each other. A first axis (center) P3 of the drive shaft 3 is parallel to a second axis (center) P4 of the driven shaft 4. The position of each movable wheel of the front bearing 30, 31 is determined by a positioning plate 39 with respect to the axes P3, P4. The positioning plate 39 is fixed by a positioning bolt 38 at each front end of the drive shaft 3 and the driven shaft 4.

As shown in FIGS. 1 and 2, the diameter of the drive shaft 3 changes in steps. That is, the drive shaft 3 has a rear drive portion 3*a*, which is a small diameter drive portion having a small diameter D2, and a front drive portion 3*b*, which is a large diameter drive portion having a large diameter D3 (D2<D3). The boundary between the rear drive portion 3*a* and the front drive portion 3*b* is positioned at the rear portion of the housing 2. Similarly, the diameter of the driven shaft 4 changes in steps. That is, the driven shaft 4 has a rear driven portion 4*a*, which is a driven small diameter portion having a small diameter D2, and a front driven portion 4*b*, which is a driven large diameter having a large diameter D3 (D2<D3). The boundary between the rear driven portion 4*a* and the front driven portion 4*b* is positioned at the rear portion of the housing 2.

Figure 5:
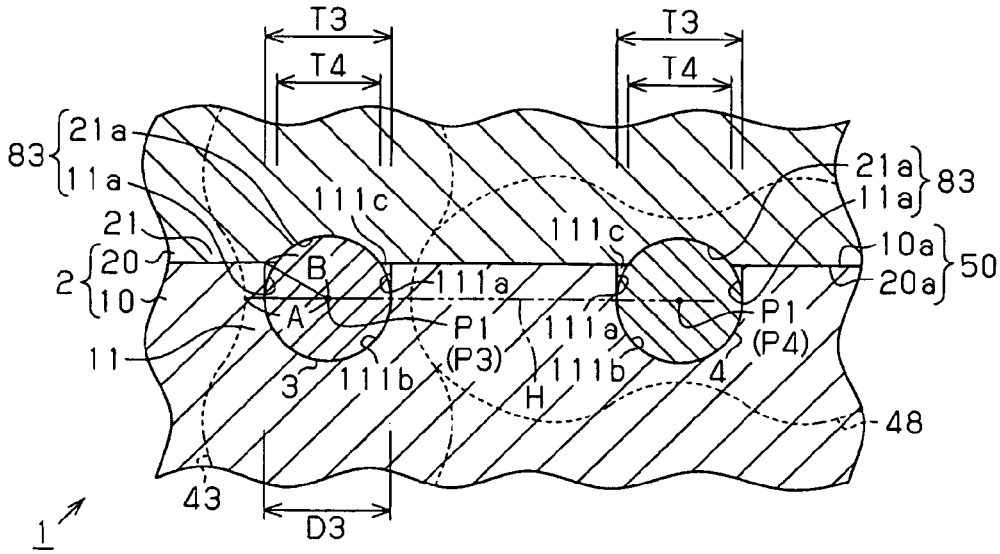
FIG. 5 is a longitudinal cross-sectional view showing a shaft accommodation portion of the housing shown in FIG. 1.

FIG. 5 shows a cross-sectional plan view of the Roots pump 1 taken along a plane that is vertical to the first axis P3 and the second axis P4. FIG. 5 shows an imaginary plane H including the first axis P3 and the second axis P4. A portion that is above the imaginary plane H is referred to as an upper portion of the Roots pump 1, and a potion that is below the imaginary plane H is referred to as a lower portion of the Roots pump 1. A direction from one of the drive shaft 3 and the driven shaft 4 to the other is referred to as a width direction of the Roots pump 1. That is, the width direction of the Roots pump 1 is a direction parallel to the imaginary plane H and is a left-right direction in FIG. 3. In other words, the width direction of the Roots pump 1 is a direction along which the drive shaft 3 and the driven shaft 4 are aligned.

As shown in FIGS. 1 and 2, a plurality of lower wall pieces 11 are formed on the lower housing member 10 so as to extend toward the upper housing member 20. The six lower wall pieces 11 are aligned along the axes P3, P4. Each of the lower wall pieces 11 has two lower shaft accommodation portions 11*a*, which are aligned along the width direction of the Roots pump 1. Each of the lower shaft accommodation portions 11*a* has a recess portion that accommodates the drive shaft 3 or the driven shaft 4.

As shown in FIG. 5, each lower shaft accommodation portion 11*a* has two straight portions 111*a* and a semicircular portion 111*b*. The semicircular portion 111*b* is a portion of the lower shaft accommodation portion 11*a* that is below the axes P3, P4. The semicircular portion 111*b* has a semicircular shape that is formed along a peripheral surface of the drive shaft 3 or the driven shaft 4. The semicircular portion 111*b* accommodates a portion of the drive shaft 3 or the driven shaft 4 that is below the axes P3, P4. The two straight portions 111*a* are portions of the lower shaft accommodation portion 11*a* that are above the axes P3, P4 and is formed in straight so as to extend up-down direction. Each of the straight portions 111*a* extends vertically with respect to the lower joint surface 10*a* continuously from the semicircular portion 111*b*.

The two straight portions 111*a* face each other with respect to the width direction of the Roots pump 1. The two straight portions 111*a* define a shaft insertion portion 111*c* therebetween. The drive shaft 3 or the driven shaft 4 can be inserted to the shaft insertion portion 111*c* from above.

The width between the two straight portions 111*a*, or an accommodation opening width T3 of the lower shaft accommodation portion 11*a*, is set to be greater than the large diameter D3 of the front drive portion 3*b* and the front driven portion 4*b*. In other words, the accommodation opening width T3 is set to be greater than the diameter (D3) of a portion of the drive shaft 3 and the driven shaft 4 that is accommodated in the lower shaft accommodation portion 11*a*.

As shown in FIGS. 1 and 2, two rear lower seal accommodation portions 12 are recessed at the rear portion of the lower housing member 10. The two rear lower seal accommodation portions 12 are arranged so as to be aligned along the width direction of the Roots pump 1. Each of the rear lower seal accommodation portions 12 accommodates a first sealing member 34. The rear lower seal accommodation portion 12 is formed in an arc shown from a front side.

Two rear lower support portions 13 are recessed at a rear side of the rear lower seal accommodation portion 12 in the rear portion of the lower housing member 10. The two rear lower support portions 13 are arranged so as to be aligned along the width direction of the Roots pump 1. Each of the rear lower support portions 13 corresponds to a rear lower bearing support portion that supports the corresponding one of the rear bearings 32, 33. The rear lower support portion 13 is formed in an arc having a larger diameter than the rear lower seal accommodation portion 12 as seen from a front side. Each of the rear lower support portions 13 accommodates a second sealing member 35. Each second sealing member 35 is located between the corresponding first sealing member 34 and the corresponding one of the rear bearings 32, 33.

For example, the first sealing member 34 and the second sealing member 35 are each one of or a combination of two or more of an oil seal, a mechanical seal, and an oil slinger. The steps formed between the front drive portion 3*b* and the rear drive portion 3*a* are located between the first sealing member 34 and the second sealing member 35. Similarly, the steps formed between the front driven portion 4*b* and the rear driven portion 4*a* are located between the first sealing member 34 and the second sealing member 35. The front drive portion 3*b* and the front driven portion 4*b* correspond to (face) the first sealing member 34 and the lower shaft accommodation portion 11*a*. The rear drive portion 3*a* and the rear driven portion 4*a* each correspond to (face) one of the second sealing members 35 and the corresponding one of the rear bearings 32, 33.

As shown in FIG. 3, opening edges (opening end portions) 13*a*, which are the uppermost portions of each rear lower support portion 13, are positioned above the centers P1 of the rear bearings 32, 33. The distance between each facing pair of the opening edges 13*a* corresponds to the opening width of the rear lower support portion 13, or a rear opening width T1, with respect to the width direction of the Roots pump 1. The rear opening width T1 is set to be smaller than the diameter D1 of the rear bearings 32, 33. The rear opening width T1 is set to be greater than the small diameter D2 of the rear drive portion 3*a* and the rear driven portion 4*a* (D2<T1<D1). In other words, the rear opening width T1 is set to be greater than the diameter (D2) of portions of the drive shaft 3 and the driven shaft 4 that are supported by the rear bearings 32, 33.

Each rear lower support portions 13 is formed in an arc having an angle greater than 180 degrees. That is, the portion of each rear lower support portion 13 that is above the centers P1 extends along an outer peripheral surface of the corresponding one of the bearings 32, 33. In other words, the portion of each rear lower support portion 13 that is above the centers P1 protrudes toward the corresponding one of the rear bearings 32, 33. The inner peripheral surface of each rear lower support portion 13 extends to the lower joint surface 10*a* that is positioned above the imaginary plane H.

Similarly, as shown in FIGS. 1 and 2, two front lower support portions 17 are recessed at the front end of the lower housing member 10. The two front lower support portions 17 are arranged so as to be aligned with respect to the width direction of the Roots pump 1. Each of the front lower support portions 17 corresponds to a front lower bearing support portion that supports the corresponding one of the front bearings 30, 31. Each front lower support portion 17 is formed in an arc as seen from a front side. The opening width of each front lower support portion 17, or a front support opening width, with respect to the width direction of the Roots pump 1 is set in the same way as the rear opening width T1. That is, the front support opening width is formed to be smaller than the diameter of the front bearings 30, 31 and set to be greater than the diameter of a portion of the drive shaft 3 and the driven shaft 4 that is supported by the front bearings 30, 31. Each front lower support portion 17 is also formed in an arc having an angle greater than 180 degrees. An upper end of each front lower support portion 17 extends to the lower joint surface 10*a* that is positioned above the imaginary plane H.

As shown in FIG. 1, the upper housing member 20 has a plurality of upper wall pieces 21 that contact the lower wall pieces 11. Each of the upper wall pieces 21 has two upper shaft accommodation portions 21*a* each of which corresponds to the lower shaft accommodation portion 11*a*. As shown in FIG. 5, each upper shaft accommodation portion 21*a* is formed in an arc having an angle smaller than 180 degrees as seen from the front side. Each upper shaft accommodation portion 21*a* covers a peripheral surface of a portion of the drive shaft 3 or the driven shaft 4 that protrudes upward from the lower joint surface 10*a*. The upper accommodation opening width T4, or an opening width of each upper shaft accommodation portion 21*a*, is set to be smaller than the diameter (D3) of a portion of the drive shaft 3 and the driven shaft 4 that is accommodated in the lower shaft accommodation portion 11*a*. The portions of the upper housing member 20 that accommodate the drive shaft 3 or the driven shaft 4 other than the upper shaft accommodation portions 21*a* are also formed in an arc like the upper shaft accommodation portions 21*a*.

As shown in FIG. 1, the rear portion of the upper housing member 20 has two rear upper seal accommodation portions 22 corresponding to the two rear lower seal accommodation portions 12, respectively. The upper housing member 20 has two rear upper support portions 23 that are located at a rear side of the rear upper seal accommodation portion 22. Each rear upper support portion 23 corresponds to one of the lower support portions 13. As shown in FIG. 3, an opening width T2 of each rear upper support portion 23 is same as the rear opening width T1.

The front portion of the upper housing member 20 has two front upper support portions 25 each of which corresponds to one of the front lower support portions 17. An opening width of each front upper support portion 25 is same as an opening width of each front lower support portion 17.

As shown in FIG. 1, the lower wall pieces 11 and the upper wall pieces 21 form end walls 60. The lower shaft accommodation portions 11*a* and the upper shaft accommodation portions 21*a* form shaft accommodation portions 83 that accommodate the drive shaft 3 or the driven shaft 4. Spaces formed between the adjacent end walls 60 along the axes P3, P4 form pump chambers 70 to 74. The volume of each of the pump chambers 70 to 74 becomes smaller from the pump chamber 70, which is located at the front side, toward the pump chamber 74, which is located at the rear side. The pump chamber 70 communicates with a suction port 24, which is formed at the upper front side of the upper housing member 20. The adjacent pump chambers 70 to 74 communicate with each other through a communication passage 75 that is formed in the lower wall piece 11. The pump chamber 74 communicates with a discharge port 14, which is formed at the lower rear side of the lower housing member 10. The discharge port 14 is connected to a discharge mechanism 16 through a connection muffler 15 and the discharge mechanism 16 is connected to an exhaust gas treatment apparatus 29.

As shown in FIG. 3, the joint portion 50 of the lower housing member 10 and the upper housing member 20 is located above the centers P1 of the rear bearings 32, 33. That is, the height of the joint portion 50 is set to be uniform in the entire joint portion 50. Specifically, the height of the joint portion 50 is located at a center between the centers P1 of the rear bearings 32, 33 and top portions Q1 of the rear bearings 32, 33.

As shown in FIG. 1, each rear lower seal accommodation portion 12 and the corresponding upper seal accommodation portion 22 form a rear seal accommodation portion 80 that accommodates the first sealing member 34. Each front lower support portion 17 and the corresponding front upper support portion 25 form a front bearing support portion 81. Each front bearing support portion 81 contacts a whole peripheral surface of the corresponding one of the front bearings 30, 31 so as to the support the front bearing 30, 31.

Each rear lower support portion 13 and the corresponding rear upper support portion 23 form a rear bearing support portion 82. Each rear bearing support portion 82 forms a bearing accommodation zone that is greater than an outer size of the rear bearing 32, 33. Each of the rear bearings 32, 33 is accommodated in the corresponding bearing accommodation zone. Each rear bearing support portion 82 contacts a whole peripheral surface of the corresponding one of the rear bearings 32, 33 so as to support the rear bearing 32, 33.

As shown in FIG. 2, a plurality of (five) drive rotors 40 to 44 are provided on the drive shaft 3 so as to be integrally rotatable. The same number of driven rotors 45 to 49 as the drive rotors 40 to 44 are provided on the driven shaft 4. As shown in FIGS. 1 and 2, the thicknesses of the drive rotors 40 to 44 and the thicknesses of the driven rotors 45 to 49 decrease from the front side to the rear side. However, each of the rotors 40 to 49 has a same shape and same size as seen from the direction of the axes P3, P4. As shown by broken lines of the rotors 43, 48 in FIG. 5, the cross-sectional shape of each of the rotors 40 to 49 that is vertical to the axes P3, P4 is formed in a shape of two lobes or formed in a shape of a gourd. In other words, each of the rotors 40 to 49 has two lobe and recesses between the lobes.

As shown in FIG. 2, the drive rotor 40 and the driven rotor 45 have a predetermined phase difference therebetween and are accommodated in the pump chamber 70 so as to be engageable with each other. Similarly, the rotors 41, 46 are accommodated in the pump chamber 71, the rotors 42, 47 are accommodated in the pump chamber 72, the rotors 43, 48 are accommodated in the pump chamber 73 and the rotors 44, 49 are accommodated in the pump chamber 74.

As shown in FIG. 5, the minimum radial size of each of the rotors 40 to 49 is referred to as a first measurement A. That is, the first measurement A represents the distance from the axes P3, P4 to the bottom of the recessed portion of each rotor 40 to 49. In other words, the first measurement A represents the radial size of the thinnest portion of each rotor 40 to 49 around the shaft 3, 4. The distance from the axes P3, P4 to an opening edge of each lower shaft accommodation portion 11*a* is referred to as a second measurement B. That is, the second measurement B represents the distance from the axes P3, P4 to the boundary between the straight portions 111*a* and the lower joint surface 10*a*. The first measurement A is set to be greater than the second measurement B. As a result, the rotors 40 to 49 always closes a space that is created between the straight portions 111*a* and the peripheral surface of the drive shaft 3 or the driven shaft 4 with respect to the axes P3, P4.

The space is located inward of a rotation locus of the rotors 40 to 49. This prevents the fluid from leaking from the pump chambers 70 to 74.

A portion of the lower housing member 10 between the rotors 44, 49 and the first sealing members 34 (see FIG. 2) also has straight portions, semicircular portions, and shaft insertion portions like the lower shaft accommodation portions 11*a*. Similarly, a portion of the lower housing member 10 between the rotors 40, 45 and the front bearings 30, 31 also has straight portions, semicircular portions, and shaft insertion portions. That is, the portion of the lower housing member 10 other than the lower shaft accommodation portions 11*a* may have portions that accommodate the drive shaft 3 and the driven shaft 4, if necessary. Similarly, the portions of the upper housing member 20 between the rotors 44, 49 and the first sealing members 34 are formed in an arc like the upper shaft accommodation portion 21*a*. The portions of the upper housing member 20 between the rotors 40, 45 and the front bearings 30, 31 are also formed in an arc like the upper shaft accommodation portion 21*a*. Each first sealing member 34 does not contact the rotor 44, 49.

As shown in FIGS. 1 and 2, a gear housing 5 is assembled to the rear end of the housing 2. The rear drive portion 3*a* and the rear driven portion 4*a* protrude into the gear housing 5. A drive gear 6 is engaged with the rear drive portion 3*a*, and a driven gear 7 is engaged with the rear driven portion 4*a*. In other words, the drive gear 6 is engaged with the rear end of the drive shaft 3, and the driven gear 7 is engaged with the rear end of the driven shaft 4. The drive gear 6 and the driven gear 7 are meshed with each other to form a gear mechanism. The drive gear 6 and the driven gear 7 are timing gears that make timing to maintain the phase difference between the drive rotors 40 to 44 and the driven rotors 45 to 49 to be a predetermined value.

An electric motor M is attached to the gear housing 5. A motor shaft M1 extending from the electric motor M is connected to the drive shaft 3 via a joint 8, which is a shaft joint. Therefore, when the electric motor M rotates the drive shaft 3, the driven shaft 4 is rotated synchronously with the drive shaft 3. As a result, each of the rotors 40 to 49 is rotated and fluid (gas) in the pump chambers 70 to 74 is transferred with pressure to the exhaust gas treatment apparatus 29 via the discharge port 14, the connection muffler 15 and the discharge mechanism 16.

Next, an assembling method of the Roots pump 1 is explained.

The drive shaft 3 having the drive rotors 40 to 44 and the driven shaft 4 having the driven rotors 45 to 49 are assembled to the lower housing member from above. Each of the rotors 40 to 49 is arranged between the lower wall pieces 11. The drive shaft 3 and the driven shaft 4 pass through the shaft insertion portions 111*c* to be accommodated in the semicircular portions 111*b*.

Figure 4:
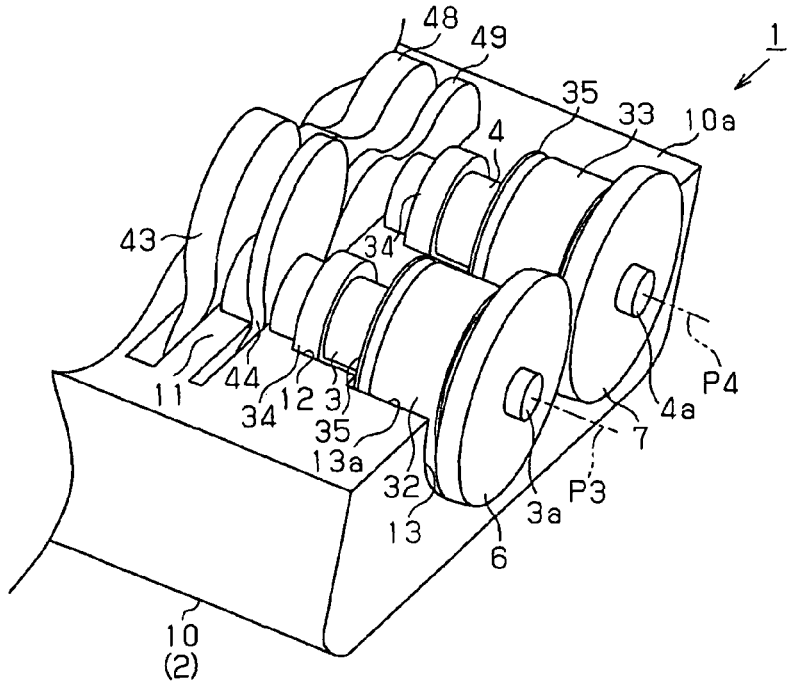
FIG. 4 is a perspective view showing a state in which two rear bearings shown in FIG. 2 support a drive shaft and a driven shaft so that the shafts are rotatable with respect to a lower housing member.

Then, the first sealing members 34, the second sealing members 35, and the bearings 32, 33 are moved along the axes P3, P4 from the rear side of the lower housing member 10 to be attached to the drive shaft 3 and the driven shaft 4, respectively (see FIG. 4). Accordingly, the rear lower support portions 13 suppress the rear bearings 32, 33 from moving upward and support the rear bearings 32, 33. The front bearings 30, 31 are moved along the axes P3, P4 from the front side of the lower housing member 10 to be attached to the drive shaft 3 and the driven shaft 4. Accordingly, the front lower support portions 17 suppress the front bearings 30, 31 from moving upward and support the front bearings 30, 31.

Next, clearances between the drive rotors 40 to 44 and the driven rotors 45 to 49 are measured and adjusted. One of the drive rotors 40 to 44 and one of the driven rotors 45 to 49 are selected. The clearance between each selected rotor and the corresponding lower wall piece 11 is measured by a clearance gauge to adjust the clearance. Measurement and adjustment of the clearance is repeated until an appropriate clearance is obtained. Since the drive rotors 40 to 44 are engaged with the drive shaft 3 and the driven rotors 45 to 49 are engaged with the driven shaft 4, the clearance between each of the other rotors and the corresponding lower wall piece 11 becomes an appropriate size when the clearance between each of the selected rotors and the corresponding lower wall piece 11 is adjusted to be an appropriate size.

After the clearances are adjusted, a fastener such as a C clip or a snap ring (not shown) is attached to an end surface of each of the rear bearings 32, 33 to determine the positions of the rear bearings 32, 33, the drive shaft 3, and the driven shaft 4 with respect to the axes P3, P4.

Then, one pair of the rotors are selected from the drive rotors 40 to 44 and the driven rotors 45 to 49 and the phase difference between the selected rotors is adjusted. Since the drive rotors 40 to 44 are arranged integrally with the drive shaft 3, the phase difference between the other pairs of rotors is simultaneously adjusted when the phase difference between the selected pair of rotors is adjusted.

Then, the drive gear 6 is engaged with the rear drive portion 3*a* and the driven gear 7 is engaged with the rear driven portion 4*a* such that the drive gear 6 is engaged with the driven gear 7. At this time, the upward force may act on the bearings 30 to 33. However, the rear lower support portions 13 and the front lower support portions 17 suppress the bearings 30 to 33 from being lifted from the lower housing member 10.

Then, the upper housing member 20 is joined to the lower housing member 10 by bolts. That is, the bolts (not shown) are inserted through the insertion holes (not shown) of the upper housing member 20 to screw the bolts to screw holes (not shown) formed in the lower housing member 10. Then, the rear drive portion 3*a* is connected to the motor shaft M1 via the joint 8. Accordingly, the assembling operation of the Roots pump 1 is completed.

The first embodiment has driven advantages.

(1) The opening edges 13*a* of each rear lower support portion 13 are located above the centers P1 of the rear bearings 32, 33. The rear opening width T1 of each rear lower support portion 13 is smaller than the diameter D1 of the rear bearings 32, 33. The opening edges of each front lower support portion 17 are also located above the centers of the front bearings 30, 31, and the opening width of each front lower support portion 17 is smaller than the diameter of the front bearings 30, 31.

Therefore, in a state where the drive shaft 3, the driven shaft 4, and the bearings 30 to 33 are mounted to the lower housing member 10, the opening edges 13*a* of the rear lower support portions 13 suppress the rear bearings 32, 33 from moving upward. Similarly, the opening edges of the front lower support portions 17 suppress the front bearings 30, 31 from moving upward. Therefore, the bearings 30 to 33 are suppressed from being separated from the lower housing member 10. In other words, the upper housing member 20 is prevented from being assembled to the lower housing member 10 in a state where the bearings 30 to 33 are separated from the lower support portions 13, 17. As a result, the phase difference between the two of the rotors 40 to 49 that are engaged to each other is prevented from being adjusted in a state where the bearings 30 to 33 are separated from the lower support portions 13, 17. In other words, the upper housing member 20 is prevented from being assembled to the lower housing member 10 in a state where the phase difference between the two of the rotors 40 to 49 is offset. Since the unnecessary movement of the bearings 30 to 33 is prevented, the adjusted clearance between each of the rotors 40 to 49 and the lower wall piece 11 is prevented from being changed.

(2) The drive shaft 3, the driven shaft 4, the bearings 30 to 33, and the rotors 40 to 49 are exposed to the outside from the lower joint surface 10*a* in a state where they are mounted to the lower housing member 10 (see FIG. 4). Therefore, all the clearances between each of the rotors 40 to 49 and the lower wall pieces 11 can be measured. Further, all the phase differences between the rotors 40 to 49 can be visually recognized. Even if the upper housing member 20 is assembled to the lower housing member 10, the positions of the bearings 30 to 33 are not changed. Therefore, the adjusted clearance or phase difference is not changed and is maintained to be an appropriate value. The drive shaft 3, the driven shaft 4, the bearings 30 to 33, and the rotors 40 to 49 are exposed to the outside from the lower joint surface 10*a* only by removing the upper-housing member 20 from the lower housing member 10. Therefore, even if the clearance or the phase difference is changed after the assembling of the housing 2, it is easily adjusted again.

(3) The whole area of the lower joint surface 10*a*, which contacts the upper housing member 20 is positioned in a single plane. Therefore, steps do not need to be formed on the lower joint surface 10*a* of the lower housing member 10. This permits the housing 2 to be manufactured easily.

(4) For example, when the lower joint surface 10*a* has steps, the upper joint surface 20*a* is joined to the lower joint surface 10*a* after the steps corresponding to the lower joint surface 10*a* are formed. If the lower joint surface 10*a* and the upper joint surface 20*a* have a dimensional tolerance, a space is likely to be created at the joint portion 50 between the lower joint surface 10*a* and the upper joint surface 20*a*. This may deteriorate the sealing property of the joint portion 50. However, since the lower joint surface 10*a* of the present embodiment is entirely flat, the upper joint surface 20*a* contacts the lower joint surface 10*a* without a gap. This improves the sealing property of the joint portion 50.

(5) The rear opening width T1 of each rear lower support portion 13 with respect to the width direction of the Roots pump 1 is set to be smaller than the diameter D1 of the rear bearings 32, 33. Further, the rear opening width T1 is set to be greater than the diameter (D2) of the portions of the drive shaft 3 and the driven shaft 4 that are supported by the rear bearing 32, 33 (D2<T1<D1). Similarly, the opening width of each front lower support portion 17 with respect to the width direction of the Roots pump 1 is set to be smaller than the diameter of the front bearings 30, 31 and is set to be greater than the diameter of the portions of the drive shaft 3 and the driven shaft 4 that are supported by the front bearings 30, 31. As a result, the bearings 30 to 33 are suppressed from being separated from the lower housing member 10. Further, the drive shaft 3 and the driven shaft 4 can be assembled to the lower housing member 10 from above.

(6) The Roots pump 1 has the drive shaft 3 and the driven shaft 4. The drive shaft 3 and the driven shaft 4 are rotated synchronously with each other by the meshing of the drive gear 6 and the driven gear 7, which are timing gears. When the drive gear 6 is meshed with the driven gear 7, the rear bearings 32, 33 might be separated from the lower housing member 10. However, since the opening edges 13*a* of the rear lower support portions 13 suppress the rear bearings 32, 33 from moving upward, the rear bearings 32, 33 are reliably suppressed from being separated.

(7) Each lower shaft accommodation portion 11*a* has the shaft insertion portion 111*c*. The accommodation opening width T3 of the shaft insertion portion 111*c* is set to be greater than the diameter (D3) of the portions of the drive shaft 3 and the driven shaft 4 that are accommodated in the lower shaft accommodation portions 11*a*. Therefore, the drive shaft 3 and the driven shaft 4 can be assembled to the lower housing member 10 from above by inserting the drive shaft 3 and the driven shaft 4 into the lower shaft accommodation portions 11*a*. Accordingly, the drive shaft 3 and the driven shaft 4 are easily mounted to the lower housing member 10.

Second Embodiment

Next, a second embodiment of the present invention will be explained with reference to FIGS. 6 to 9. The first sealing member 34 and the second sealing member 35 of the first embodiment are modified in the second embodiment. Like or the same reference numerals are given to those components that are like or the same as the corresponding components of the first embodiment, and detailed explanations are omitted.

Figure 6:
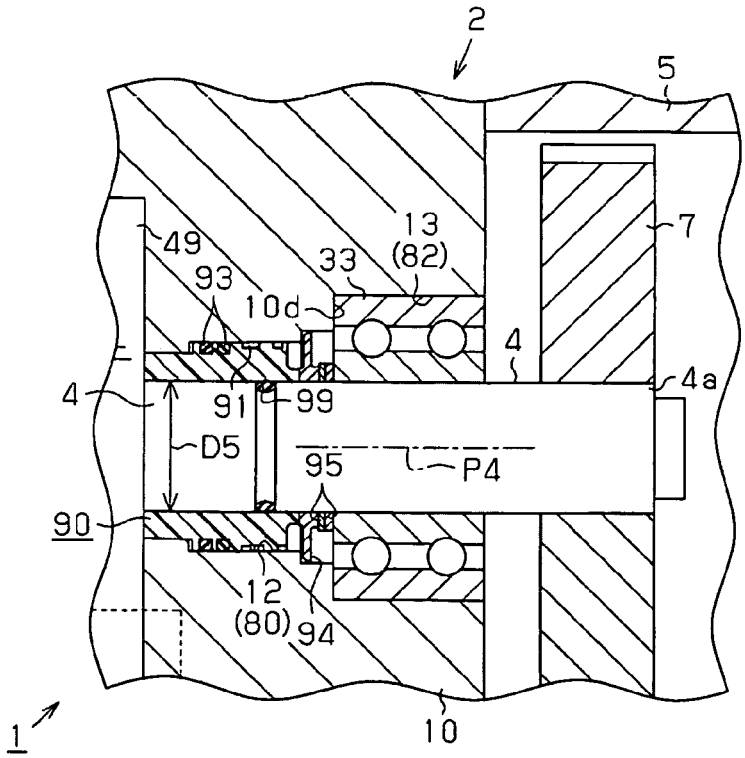
FIG. 6 is an enlarged longitudinal cross-sectional view showing a rear seal accommodation portion according to a second embodiment of the present invention.
Figure 7:
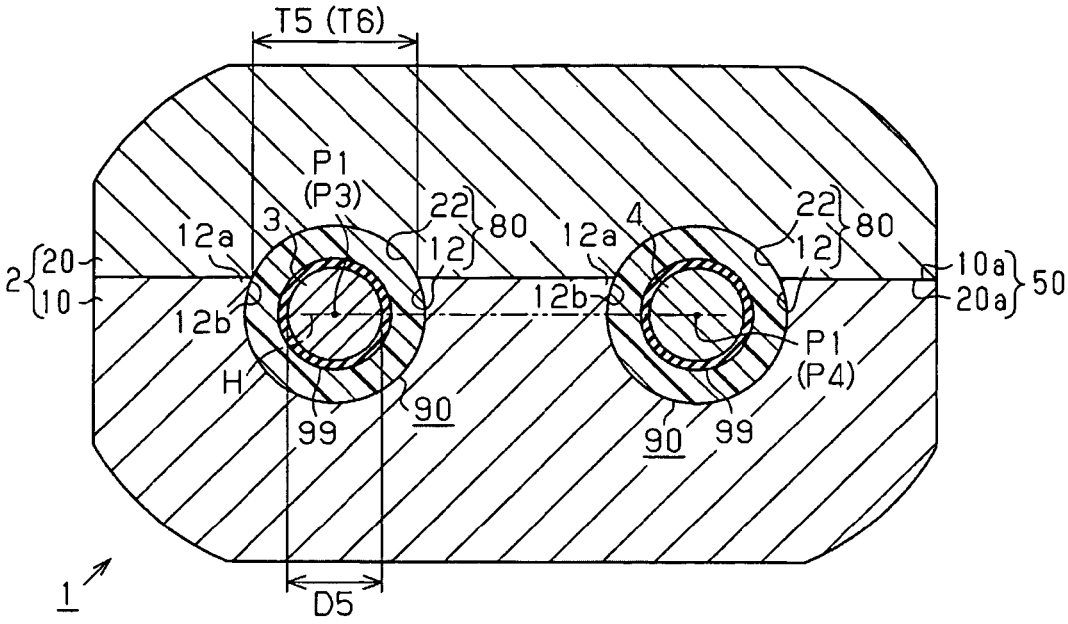
FIG. 7 is a cross-sectional plan view showing the rear seal accommodation portion of FIG. 6.

As shown in FIGS. 6 and 7, each lower seal accommodation portion 12 has an arc that has an angle greater than 180 degrees. That is, opening edges 12*a*, which are the uppermost portions of each rear lower seal accommodation portion 12, are located above the axes P3, P4. In other words, the opening edges 12*a* extend to the lower joint surface 10*a*, which is above the imaginary plane H.

The rear opening width T5 with respect to the width direction of the Roots pump 1 is set to be greater than the diameter (D5) of the portions of the drive shaft 3 and the driven shaft 4 that are arranged in the rear seal accommodation portion 80. That is, the rear opening width T5, which is the width between two opening edges 12*a*, is greater than the diameter D5. The diameter (D5) of the portion of the drive shaft 3 and the driven shaft 4 that is arranged in the rear seal accommodation portion 80 can be set to be smaller than the diameter D3 or D2 of the first embodiment.

Each shaft insertion portion 12*b* is defined between the corresponding pair of the opening edges 12*a*. The drive shaft 3 and the driven shaft 4 can be inserted to the rear lower seal accommodation portions 12 from above by passing through the shaft insertion portions 12*b*. A cylindrical rear sealing member 90 is accommodated in each rear lower seal accommodation portion 12. The rear sealing members 90 are attached to the drive shaft 3 and the driven shaft 4. Each rear sealing member 90 seals a space between the drive shaft 3 or the driven shaft 4 and the corresponding rear seal accommodation portion 80.

The inner surface of each rear upper seal accommodation portion 22 is formed in an arc as seen from the front side. Each rear upper seal accommodation portion 22 is formed in an arc so as to cover the peripheral surface of the rear sealing member 90 that protrudes upward from the lower joint surface 10*a*. The opening width T6 of the rear upper seal accommodation portion 22 is set to be the same as the rear opening width T5.

As shown in FIGS. 6 and 7, an annular space exists between the inner peripheral surface of each rear seal accommodation portion 80 and the peripheral surface of the drive shaft 3 or the driven shaft 4. The rear sealing members 90 are arranged in the spaces. The rear sealing members 90 are formed of a synthetic resin material. The rear sealing members 90 is fitted to the drive shaft 3 and the driven shaft 4 so as to be rotated integrally with the drive shaft 3 and the driven shaft 4.

As shown in FIG. 6, the front end surface of each rear sealing member 90 closely contacts the rear end surface of the corresponding rotor 44, 49 to suppress fluid leakage. A rear O ring 99 is arranged between the inner peripheral surface of each rear sealing member 90 and the peripheral surface of the drive shaft 3 or the driven shaft 4.

As shown in FIG. 6, a rear spiral groove 91 is formed on an outer peripheral surface of each rear sealing member 90 at a portion close to the rear bearing 32, 33. The rear spiral grooves 91 have a pumping operation for transporting fluid and lubricating oil contained in the fluid from the pump chamber 74 to the rear bearings 32, 33 as the drive shaft 3 and the driven shaft 4 are rotated. As a result, the lubricating oil is easily supplied to the rear bearings 32, 33, the drive gear 6, and the driven gear 7. That is, the rear spiral grooves 91 have a pumping function for transporting the lubricating oil between the outer peripheral surfaces of the rear sealing members 90 and the inner peripheral surface of the rear seal accommodation portions 80 to the rear bearings 32, 33 that form an oil existing zone. The spiral grooves 91 are shifted from the rear bearings 32, 33 toward the pump chamber 74 along the rotational directions of the drive shaft 3 and the driven shaft 4.

Two rear seal rings 93 are arranged on the outer peripheral surface of each rear sealing member 90 at a portion close to the pump chamber 74. The rear seal rings 93 seal a space between the inner peripheral surface of each rear seal accommodation portion 80 and the outer peripheral surface of the corresponding rear sealing member 90.

As shown in FIGS. 6 and 7, an oil slinger 94 is arranged between each rear sealing member 90 and the corresponding rear bearing 32, 33. A shim 95 is arranged between the oil slinger 94 and the rear bearing 32, 33. The shim 95 maintains the adjusted clearance between each of the rotors 40 to 49 and the lower wall pieces 11.

Figure 8:
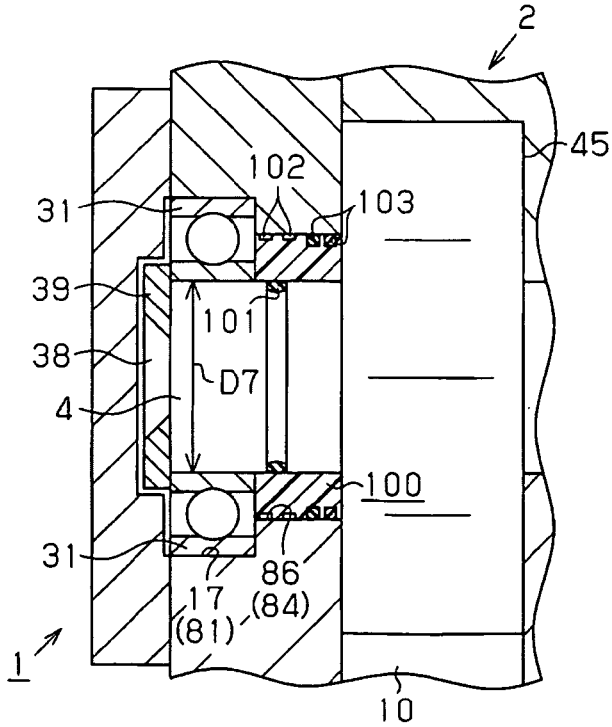
FIG. 8 is an enlarged longitudinal cross-sectional view showing a front seal accommodation portion according to the second embodiment.
Figure 9:
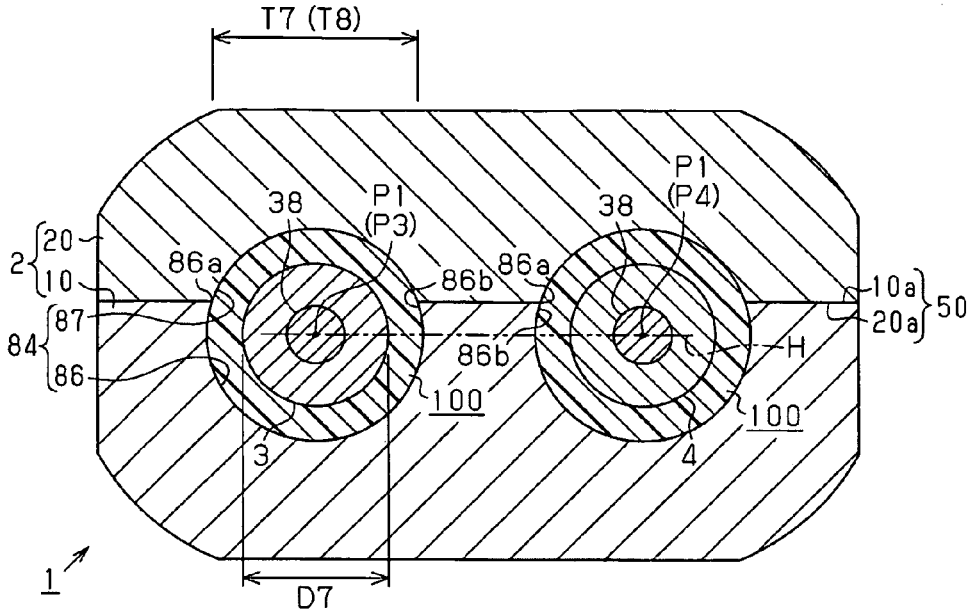
FIG. 9 is a cross-sectional plan view showing the front seal accommodation portion of FIG. 8.

As shown in FIGS. 8 and 9, two front seal accommodation portions 84 are formed at the front portion of the housing 2 between each front bearing support portion 81 and each of the rotors 40, 45. Each of the front seal accommodation portions 84 that are aligned along the width direction of the Roots pump 1 is formed to be a circular hole.

As shown in FIG. 9, each front seal accommodation portion 84 has a front lower seal accommodation portion 86 formed in the lower housing member 10 and a front upper seal accommodation portion 87 formed in the upper housing member 20. The front opening width T7 of each front lower seal accommodation portion 86 with respect to the width direction of the Roots pump 1 is set to be greater than the diameter (D7) of the portions of the drive shaft 3 and the driven shaft 4 that is arranged are the front seal accommodation portions 84. The opening edges 86*a*, which are the uppermost portions of each front lower seal accommodation portion 86, are above the center of a front sealing member 100 and above the axes P3, P4.

Each front lower seal accommodation portion 86 has an arc having an angle greater than 180 degrees. A shaft insertion portion 86*b* is defined between each facing pair of the opening edges 86*a*. The drive shaft 3 and the driven shaft 4 pass through the shaft insertion portions 86*b* to be inserted to the lower seal accommodation portions 86 from above. Each front lower seal accommodation portion 86 accommodates the cylindrical front sealing member 100.

Each front upper seal accommodation portion 87 is formed in an arc along the peripheral surface of the front sealing member 100. The opening width T8 of each front upper seal accommodation portion 87 is set to be the same as the front opening width T7.

As shown in FIGS. 8 and 9, each front sealing member 100 seals a space between the inner peripheral surface of the corresponding front seal accommodation portion 84 and the peripheral surface of the corresponding one of the drive shaft 3 and the driven shaft 4. The front sealing members 100 made of a synthetic resin material are fitted to the drive shaft 3 and the driven shaft 4 so as to be rotated integrally with the drive shaft 3 and the driven shaft 4.

As shown in FIG. 8, the rear end surface of each front sealing member 100 closely contacts the front end surface of the corresponding rotor 40, 45 so as to suppress fluid leakage. As shown in FIG. 8, a front O ring 101 is arranged in a portion between the inner peripheral surface of each front sealing member 100 and the peripheral surface of the corresponding one of the drive shaft 3 and the driven shaft 4. The front O ring 101 seals a space between the peripheral surface of each shaft 3, 4 and the inner peripheral surface of the front sealing member 100.

As shown in FIG. 8, on the outer peripheral surface of each front sealing member 100, a labyrinth seal 102 is formed in a portion that is close to the front bearing 30, 31, and two front seal rings 103 are arranged in a portion that is close to the pump chamber 70. Each front seal ring 103 seals a space between the inner peripheral surface of the corresponding front seal accommodation portion 84 and the outer peripheral surface of the corresponding front sealing member 100.

Next, an assembling method of the Roots pump 1 according to the second embodiment will be explained.

The drive shaft 3 having the drive rotors 40 to 44 and the driven shaft 4 having the driven rotors 45 to 49 are inserted to the lower housing member 10 from above. In this state, the rear sealing members 90, the oil slingers 94, the shims 95, and the rear bearings 32, 33 are moved along the axes P3, P4 from the rear side of the lower housing member 10 in this order to be attached to the drive shaft 3 and the driven shaft 4. The rear sealing members 90 are closely fitted to the drive shaft 3 and the driven shaft 4 so as to be rotated integrally therewith. Then, the rear bearings 32, 33 are inserted to the rear lower support portion 13. The rear bearings 32, 33 contact the step portions 10*d* formed between the rear lower seal accommodation portions 12 and the rear lower support portions 13.

The front sealing member 100 are attached to the drive shaft 3 and the driven shaft 4 from the front side of the lower housing member 10. The front sealing members 100 are closely fitted to the drive shaft 3 and the driven shaft 4 so as to be rotated integrally therewith. The front bearings 30, 31 are inserted to the front lower support portions 17. The front bearings 30, 31 contact the front sealing members 100.

Next, the clearance between each of the rotors 40 to 49 and the corresponding lower wall piece 11 is measured and adjusted to an appropriate size. Then, the shims 95 are adjusted. Thereafter, the drive gear 6 and the driven gear 7 are engaged with the drive shaft 3 and the driven shaft 4 such that the upper housing member 20 is joined to the lower housing member 10.

The second embodiment has the following advantage in addition to the advantages (1) to (7) of the first embodiment.

(8) The diameters (D5, D7) of the drive shaft 3 and the driven shaft 4 are set to be smaller than the opening widths T5, T7 of the lower seal accommodation portions 12, 86 such that the drive shaft 3 and the driven shaft 4 can be inserted to the seal accommodation portions 80, 84 from above. The height of the opening edges 12*a*, 86*a* of the lower seal accommodation portions 12, 86 is set to be higher than the centers of the sealing members 90, 100. Each cylindrical sealing member 90, 100 seals the space between the inner peripheral surface of the seal accommodation portion 80, 84 and the peripheral surface of the drive shaft 3 or the driven shaft 4. Therefore, the straight portions (see 111*a*) for inserting the drive shaft 3 and the driven shaft 4 are deleted from the corresponding portion of the lower housing member 10 between the front bearing 30 and the drive rotor 40, between the front bearing 31 and the driven rotor 45, between the rear bearing 32 and the drive rotor 44, and between the rear bearing 33 and the driven rotor 49. Accordingly, the space between one of the peripheral surfaces of the first rotary shaft and the driven shaft 4, and the corresponding one of the inner peripheral surfaces of the seal accommodation portions 80, 84 is easily sealed.

Each of the above embodiments is not limited thereto but may be modified as follows.

The height of the uppermost portion of the lower housing member 10, that is, the height of the opening edges 13*a* of each lower support portion 13, 17 may be at any position as long as it is above the center P1 of the bearing 30, 33. The opening width T1 of each lower support portion 13, 17 needs to be greater than the diameter (D2) of the drive shaft 3 and the driven shaft 4. For example, the height of the opening edges 13*a* may be set above or below the center between the center P1 of the rear bearings 32, 33 and the top portion Q1 of the rear bearings 32, 33.

The height of the portion of the lower housing member 10 other than the opening edges 13*a* of the lower support portions 13, 17 may be below the centers of the front bearings 30, 31 or the centers P1 of the rear bearings 32, 33. That is, only the opening edges 13*a* of the lower support portion 13, 17 may be set to be above the centers P1 of the bearings 30 to 33. The height of the upper surface of the lower wall piece 11 may be set to be the same as the axes P3, P4. By extending the upper wall pieces 21 to contact the lower wall piece 11, fluid leakage between the adjacent pump chambers 70 to 74 is suppressed. The height of only the opening edges of each lower shaft accommodation portion 11*a*, which are the upper ends of the lower shaft accommodation portion 11*a*, may be set to be the same as the axes P3, P4. That is, the height of only the portion of the lower joint surface 10*a* corresponding to the lower shaft accommodation portions 11*a* may be set to be the same as the axes P3, P4. In this case, the space between each lower shaft accommodation portion 11*a* and the drive shaft 3 or the driven shaft 4 may be reduced. This easily suppresses fluid that is transported by the rotors 40 to 49 from passing through the space between the lower shaft accommodation portions 11*a* and the peripheral surface of the drive shaft 3 or the driven shaft 4 and leaking therefrom.

As long as the rear opening width T1 of the rear lower support portions 13 is smaller than the diameter D1 of the rear bearings 32, 33, the other portion of the rear bearing support portions 82 may be deformed so as to correspond to the outer shape of the rear bearings 32, 33. For example, the curvature of the arc of the rear upper support portions 23 may be set to be smaller than that of the arc of the rear lower support portions 13.

The size and the shape of each pump chamber 70 to 74 may be changed according to the size and the shape of each rotor 40 to 49.

The present invention may be applied to a fluid machine other than the Roots pump 1, for example, a screw pump or a claw pump. The fluid machine may be any machine that transports fluid by rotation of the drive shaft 3 and the driven shaft 4 having the rotors 40 to 49.

Figure 10:
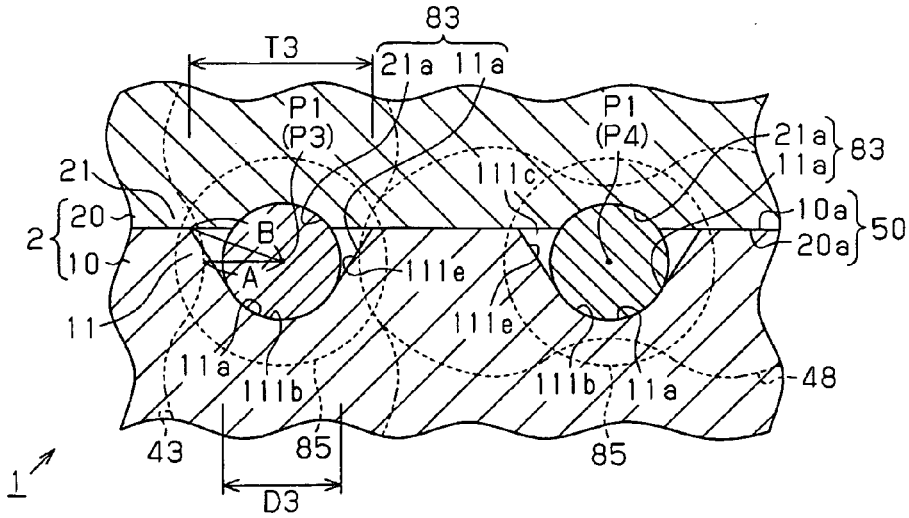
FIG. 10 is a cross-sectional plan view showing a lower shaft accommodation portion of a modification.

As shown in FIG. 10, each lower shaft accommodation portion 11*a* may have enlarging portions 111*e* instead of the straight portions 111*a*. The enlarging portions 111*e* increases the width of the lower shaft accommodation portion 11*a* gradually from the semicircular portion 111*b* toward the lower joint surface 10*a*. That is, the accommodation open width T3 of each lower shaft accommodation portion 11*a* may be greater than the diameter (D3) of the drive shaft 3 and the driven shaft 4 with respect to the width direction of the Roots pump 1. The drive shaft 3 or the driven shaft 4 can be inserted to the lower shaft accommodation portion 11*a*. The shaft insertion portion 111*c* is defined between the two facing enlarging portions 111*e*.

As shown in FIG. 10, a second measurement B represents the distance from the axes P3, P4 to the boundary between each enlarging portion 111*e* and the lower joint surface 10*a*. The first measurement A may be shorter than the second measurement B. In this case, a disk-like seal plate 85 is integrally provided on the drive shaft 3 and the driven shaft 4 respectively so as to suppress fluid leakage from the space between each of the rotors 40 to 49 and the enlarging portion 111*e*. Each seal plate 85 is provided between each of the rotors 40 to 49 and the lower wall pieces 11. A radius of the seal plate 85 is longer than the first measurement A and the second measurement B.

The sealing members 90, 100 do not need to be rotated integrally with the drive shaft 3 or the driven shaft 4, but may be fixed to the inner peripheral surfaces of the seal accommodation portions 80, 84, respectively.

The housing 2 does not need to have two rotary shafts, but may have only one rotary shaft. In this case, an upward force acts on the bearing when the bearing is press-fitted to the rear lower support portion 13. The rear lower support portion 13 suppresses the bearing from being separated.

The number of the pump chambers in the housing 2 may be changed and may be one.

The invention claimed is:

1. A fluid machine comprising:

a housing, a drive shaft and a driven shaft that are aligned so as to be parallel to each other in the housing, wherein the housing supports the drive shaft and the driven shaft with a plurality of bearings, a drive gear provided on the drive shaft, a driven gear provided on the driven shaft, wherein the drive gear is meshed with the driven gear, and rotation of the drive shaft is transmitted from the drive gear to the driven gear so that the driven shaft is rotated synchronously with the drive shaft, a drive rotor that is provided on the drive shaft, and a driven rotor provided on the driven shaft, wherein the drive rotor and the driven rotor are engaged to each other so as to be rotatable according to the rotation transmission from the drive shaft to the driven gear, wherein the plurality of bearings are attached to the housing, and the drive rotor is rotated by rotation of the drive shaft, the driven rotor is rotated by rotation of the driven shaft, and the machine transports fluid through rotation of the drive and driven rotors, wherein the housing has a two-piece structure having a lower housing member and an upper housing member that is joined to the lower housing member, wherein the lower housing member has a lower bearing support portion that is open upward, wherein the upper housing member has an upper bearing support portion that makes a pair with the lower bearing support portion, and the upper bearing support portion is open downward, wherein the lower bearing support portion and the upper bearing support portion support the plurality of bearings, wherein an uppermost portion of the lower bearing support portion is positioned above a center of each of the plurality of bearings, and an opening width of the lower bearing support portion for each of the plurality of bearings is smaller than the diameter of each of the plurality of bearings.

2. The fluid machine according to claim 1, wherein the lower housing member has a joint surface that contacts the upper housing member, and the entire joint surface is positioned in a single plane.

3. The fluid machine according to claim 1, wherein the lower housing member has a lower shaft accommodation portion that accommodates the drive shaft, the driven shaft and a joint surface that contacts the upper housing member, wherein the height of a portion of the joint surface that corresponds to at least the lower shaft accommodation portion is set to be the same as the height of an axis of each of the drive and driven shafts.

4. The fluid machine according to claim 1, wherein the lower housing member has a lower shaft accommodation portion that accommodates the drive shaft and the driven shaft, a pair of shaft insertion portions are defined in the lower shaft accommodation portion, wherein each one of the shaft insertion portions has an opening width that is greater than the diameter of a portion of each of the drive and driven shafts that is accommodated in the lower shaft accommodation portion.

5. The fluid machine according to claim 1, wherein the housing has a seal accommodation portion, and the seal accommodation portion accommodates a cylindrical sealing member that seals a space between an inner peripheral surface of the housing and a peripheral surface of each of the drive and driven shafts, and the seal accommodation portion has a lower seal accommodation portion that is formed in the lower housing member and an upper seal accommodation portion that is formed in the upper housing member, wherein the lower seal accommodation portion opens upward, and the upper seal accommodation portion makes a pair with the lower seal accommodation portion, wherein the upper seal accommodation portion opens downward, wherein a pair of shaft insertion portions into which each of the drive and driven shafts is respectively inserted is formed in the lower seal accommodation portion, and each one of the pair of shaft insertion portions has an opening width that is greater than the diameter of a portion of each of the drive and driven shafts that is accommodated in the seal accommodation portion.

* * * * *